United States Patent [19]

Schwabe

[11] 4,042,048

[45] Aug. 16, 1977

[54] DRILLING TECHNIQUE

[76] Inventor: Willie Carl Schwabe, 5925 Killarney, Corpus Christi, Tex. 78412

[21] Appl. No.: 734,884

[22] Filed: Oct. 22, 1976

[51] Int. Cl.[2] ..... E21B 7/16

[52] U.S. Cl. ..... 175/380; 175/207; 175/394

[58] Field of Search ..... 175/54, 207, 208, 380, 175/329, 394, 209–218; 166/75; 209/159, 17, 254; 134/104, 109

[56] References Cited

U.S. PATENT DOCUMENTS

| | | | |
|---|---|---|---|
| 1,343,902 | 6/1920 | Chapman | 175/380 |
| 1,420,365 | 6/1922 | Chapman | 175/380 |
| 1,452,734 | 4/1923 | Griesche | 175/380 |
| 2,013,070 | 9/1935 | Sheridan | 175/207 |
| 2,276,075 | 3/1942 | Wuensch | 175/208 |
| 2,441,881 | 5/1948 | Hays | 175/394 |
| 2,553,701 | 5/1951 | Comstock | 175/329 |
| 2,576,283 | 11/1951 | Chaney | 175/208 |
| 3,132,852 | 5/1964 | Dolbear | 175/54 |

*Primary Examiner*—James A. Leppink

[57] ABSTRACT

There is disclosed a technique for drilling a well bore in which a slurry of drilling fluid and pellets is pumped through the drill pipe into a drill head. The pellets exit from the drill head and are captivated between the drill head and the bore hole. Upon rotation of the drill head, the pellets shot drill the bottom and side wall of the bore hole.

7 Claims, 4 Drawing Figures

DRILLING TECHNIQUE

This invention relates to a novel method and apparatus for the drilling of bore holes by a shot drilling technique.

Shot drilling techniques are, of course, known in the prior art as exemplified by U.S. Pat. Nos. 649,488; 817,296; 842,577; 1,452,734 and 1,540,882. Also of interest with respect to this invention are the disclosures in U.S. Pat. Nos. 1,343,902; 1,420,365 and 2,727,726 and Russian Pat. No. 130,444.

It is an object of this invention to provide an improved drilling technique using a shot drilling effect.

Another object of this invention is to provide an improved method and apparatus for drilling a bottom of a bore hole with a shot drilling technique.

In summary, one aspect of this invention comprises an apparatus for drilling a bore hole in the earth including a hollow drill head having an inlet for receiving a drilling fluid-pellet mixture, and a bottom having a multiplicity of shoulders extending away from the bottom center and defining a groove between adjacent shoulders, and a multiplicity of shot conducting passages providing communication between the drill head interior and each of the grooves for introducing shot between the drill head bottom and the well bore bottom.

In summary, another aspect of this invention comprises an apparatus for drilling a well bore, including a hollow drill head having an inlet for receiving a drilling fluid-pellet mixture, and a bottom having a multiplicity of tapered shoulders extending away from the bottom center and defining a multiplicity of radially outermost apices, and a multiplicity of shot conducting passages providing communication between the drill head interior and each of the shoulders at a location spaced radially inward of the apex thereof for introducing the pellets between the drill head bottom and the well bore bottom.

Figure 1:
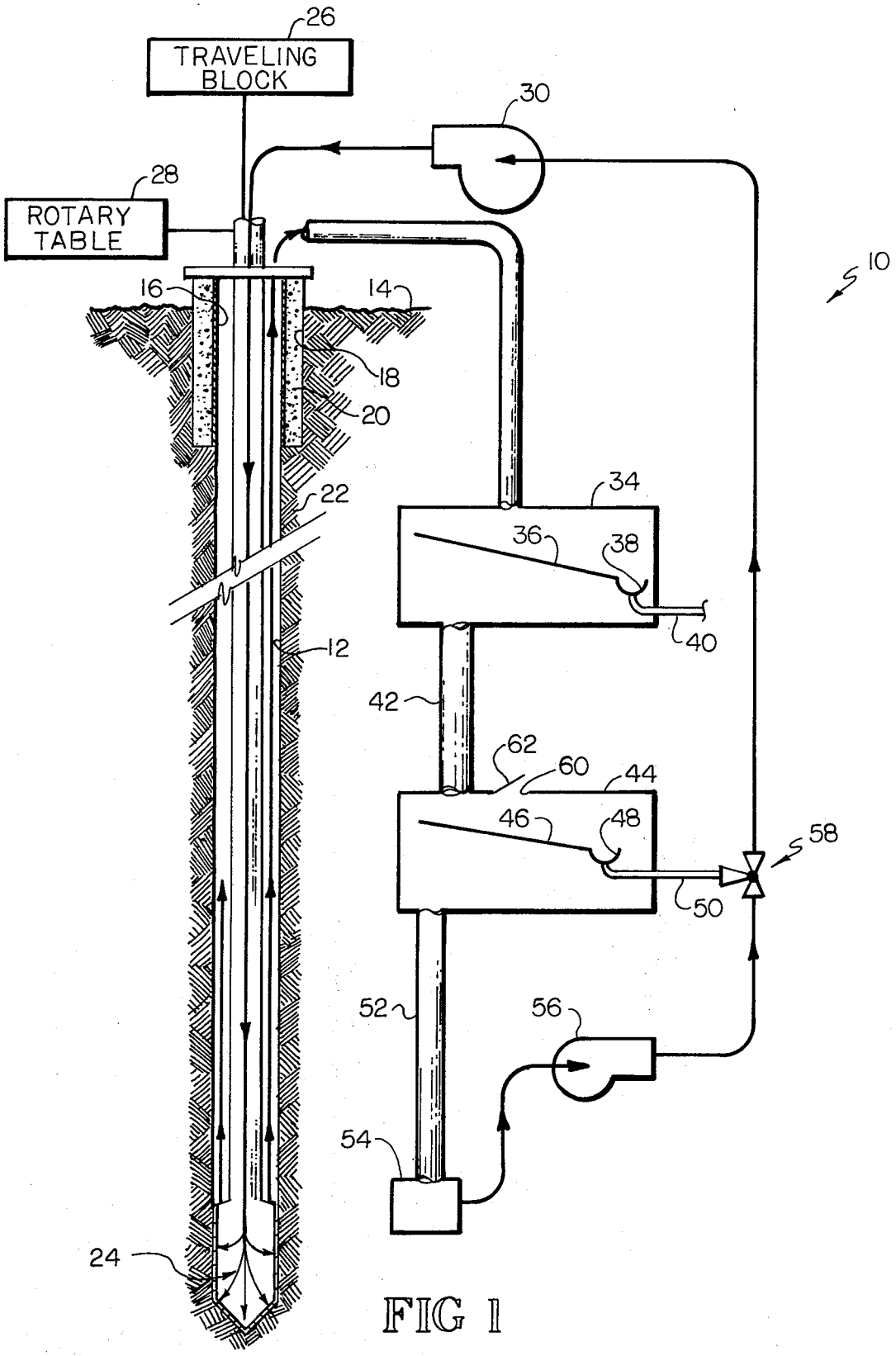
FIG. 1 is an overall skematic view of a device of this invention.

Referring to FIG. 1, there is illustrated a drilling system 10 for drilling a bore hole or well bore 12 downwardly into the earth from the surface 14. The bore hole 12 is illustrated as extending through a string of surface casing 16 cemented in a surface hole 18 by a cement sheath 20. Extending into the bore hole 12 is a string of drill pipe 22 which typically comprises a plurality of threaded joints having a drill head or mandrel 24 of this invention on the bottom thereof. The bore hole 12 is being drilled by a drilling rig (not shown) having a traveling block 26 operatively connected to the drill string 22 for raising and lowering the same in a conventional manner and a rotary table 28 for rotating the drilling string 22 in a suitable fashion.

A mixture or slurry of drilling fluid and pellets is pumped by a suitable pump 30 into the interior passage of the drill string 22 and exits through the drill head 24. As will be more fully explained hereinafter, the pellets become captivated between the drill head 24 and the bottom or side wall of the bore hole 12 and are forced thereagainst by the drill head 24 to effect shot drilling. Drilling fluid, pellets and cuttings exit from between the drill head 24 and the bore hole 12 into the annulus between the drill string 22 and the bore hole 12 and flow upwardly to the surface 14 and pass into a return mud line or conduit 32. The conduit 32 delivers the drilling fluid-pellet-cuttings mixture to a shale shaker or other separator 34 having a large mesh screen 36 therein which acts to collect relatively large cuttings in a trough 38 which are drawn off through a suitable conduit 40. The mesh of the screen 36 is selected to pass the pellets, drilling fluid and small cuttings.

A conduit 42 delivers the mixture of drilling fluid-pellets-small cuttings to a second separator 44 having a relatively small mesh screen 46 therein which acts to collect the pellets and deliver the same to a trough 48. The pellets are drawn off through a conduit 50 and may be washed, if desired, before recirculation.

A conduit 52 delivers a mixture of drilling fluid and small cuttings from the separator 44 to a mud pit or tank 54 where the small cuttings are either separated from the drilling fluid by mechanical devices or allowed to settle out by gravity.

A suitable pump 56 has its suction arranged to receive drilling fluid from the tank 54 and delivers the same to a proportioning device 58 of any suitable type adapted to proportion the amount of drilling fluid to the amount of pellets. The proportioning device 58 may, for example, comprise a typical hopper through which solids are conventionally added to drilling mud. The pump 30 has its suction arranged to receive the drilling fluid-pellet mixture from the device 58. It will accordingly be apparent that the drilling fluid and pellets are recirculated through the well bore 12. It will be apparent that one may need to add pellets periodically to the drilling system 10. This may readily be accomplished by dumping pellets through an opening 60 in the top of the separator 44. A suitable hatch or cover 62 may be provided to close the opening 60.

Figure 2:
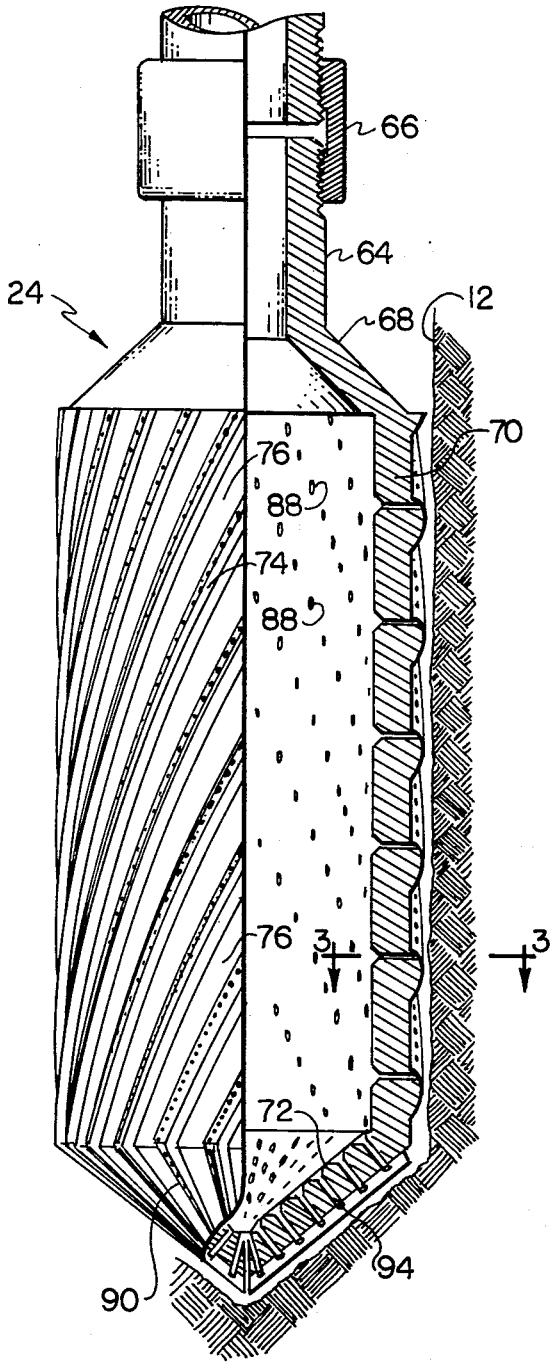
FIG. 2 is an enlarged, partially cross-sectional view, of a drill head of this invention.

Referring to FIG. 2, the drill head or mandrel 24 is illustrated in greater detail. The drill head 24 comprises an inlet section 64 having an upper threaded end connected by a coupling 66 to the lowermost joint of the drill string 22. The drill head 24 further comprises an upper section 68 integral with the inlet section 64, a cylindrical section 70 integral with the upper section 68 and a conical bottom section 72 integral with the cylindrical section 70.

Figure 3:
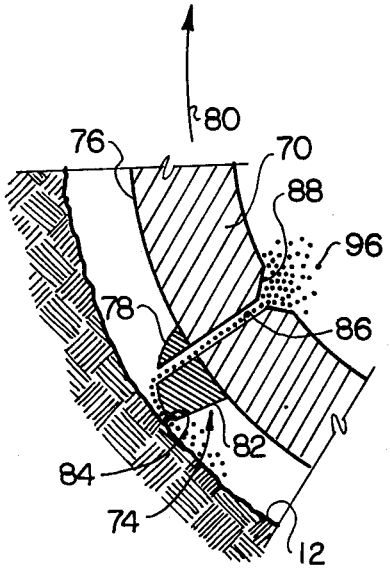
FIG. 3 is an enlarged cross-sectional view of the device of FIG. 2, taken substantially along line 3—3 thereof, as viewed in the direction indicated by the arrows.

The cylindrical section 70 comprises a plurality of spirally disposed external ribs or shoulders 74 defining therebetween a plurality of grooves 76. As shown best in FIG. 3, the ribs 74 are generally tapered, providing an arcuate face 78 facing in the direction of rotation, indicated by the arrow 80, and a generally linear face 82 facing opposite from the direction of rotation. The faces 78, 82 meet at a radially outermost apex 84. A multiplicity of passages 86 open into the interior of the mandrel 24 through an enlarged inlet 88 and open into the groove 76 through the arcuate face 78 of the rib 74 at a location radially inward of the apex 84.

Figure 4:
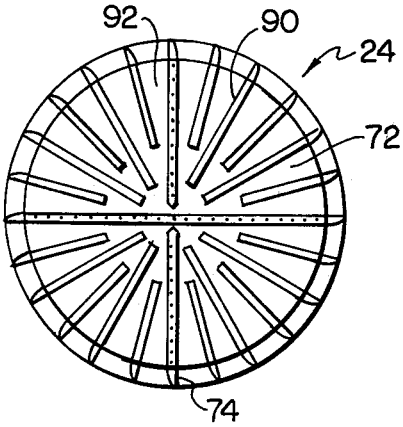
FIG. 4 is a bottom view of the drill head of FIG. 2.

As shown best in FIGS. 2 and 4, the bottom section comprises a plurality of ribs or shoulders 90 radiating from the center of the bottom section 72. The ribs 90 are of substantially the same cross-sectional shape as the ribs 74 and define a plurality of grooves 92 therebetween. A plurality of passages 94 communicate between the interior of the drill head 24 and the grooves 92 through the arcuate face of the shoulders 90 in much the same manner as the passages 86 provide communication between the interior of the drill head and the grooves 76. Because it is desired to provide as many passages 94 as possible through the bottom 72, the bottom 72 is conveniently conical to provide a greater surface area than a flat bottomed drill.

The pellets 96 may be of any suitable size and composition commensurate with the functions to be performed. The pellets 96 are preferably rather small, e.g. less than about ⅛th inch in diameter. It will accordingly be apparent that the mesh of the screens 36, 46 may be selected respectively to pass and to reject the pellets 96. It is also apparent that the pellets 96 are substantially smaller than the width of the grooves 76, 90, as measured between the respective ribs 74, 88. It is also evident that the pellets 94 are substantially smaller than the depth of the grooves 76, 90, as measured between the maximum heights of the respective ribs 74, 88 and the external surface of the sections 70, 72.

The pellets 96 are preferably substantially spherical because of the inherent mechanical strength of a sphere. It will accordingly be apparent that the pellets 96 are desirably metal spheres having the desired properties of impact resistance, hardness and toughness. It will be apparent that iron, steel and other ferrous alloys may be employed to prepare the pellets 96.

In use, the drilling fluid-pellet slurry or mixture is pumped down the drill string 22. The pellets 96 tend to collect inside the drill head 24 adjacent the inlets 88 as suggested in FIG. 3. The pellets 96 are continuously or intermittently expressed through the passages 86, 94 in a stream of drilling fluid. During rotation of the drill head 24 by the rotary table 28, the pellets 96 become captivated between the arcuate face of the ribs 74, 90 and shot drill the bottom and side wall of the bore hole 12. A mixture of drilling fluid-pellets-cuttings passes upwardly in the gap between the drill head 24 and the bore hole 12 through the grooves 92, 76. As this stream clears the top of the drill head 24, the upward flow velocity decreases in the annulus between the bore hole 12 and the drill string 22. The volume of slurry pumped into the drill string 22 is designed to be sufficient to carry the pellets 96 and cuttings upwardly through the annulus into the return conduit 32.

I claim:

1. Apparatus for shot drilling a well bore, comprising:
a hollow drill head having
an inlet section for receiving a drilling fluid-shot mixture; and
a bottom having a multiplicity of shoulders of generally tapered configuration providing a radially outermost apex extending away from the bottom center and defining a groove between adjacent shoulders, and a multiplicity of shot conducting passages opening through the shoulders at a location spaced radially inward of the shoulder apex providing communication between the drill head interior and each of the grooves for introducing shot between the drill head bottom and the well bore bottom.

2. The apparatus of claim 1 wherein the drill head provides a direction of rotation and the passages open through the shoulders at a location spaced from the apex in the direction of rotation.

3. The apparatus of claim 1 wherein the bottom is of generally conical configuration and the shoulders extend from adjacent the bottom center to adjacent the periphery of the bottom.

4. The apparatus of claim 3 wherein the passages are substantially smaller than the width and depth of the grooves.

5. The apparatus of claim 4 wherein the drill head includes a central cylindrical section integral with the bottom and the inlet section; the central section comprising a multiplicity of shoulders helically arranged about the central section and defining a groove between adjacent shoulders, and a multiplicity of shot conducting passages providing communication between the drill head interior and each of the grooves for introducing shot between the central section and the side of the well bore.

6. The apparatus of claim 5 wherein the helical shoulders are generally tapered in cross-section providing a radially outermost apex and the multiplicity of passages open through the helical shoulders at locations spaced radially inward of the shoulder apex.

7. The apparatus of claim 6 wherein the drill head provides a direction of rotation and the passages through the helical shoulders open through the shoulders at a location spaced from the shoulder apex in the direction of rotation.

* * * * *